US006808442B1

(12) United States Patent
Wei et al.

(10) Patent No.: US 6,808,442 B1
(45) Date of Patent: Oct. 26, 2004

(54) APPARATUS FOR REMOVAL/REMAINING THICKNESS PROFILE MANIPULATION

(75) Inventors: David Wei, Fremont, CA (US); Yehiel Gotkis, Fremont, CA (US); Aleksander Owczarz, San Jose, CA (US); John M. Boyd, Atascadero, CA (US); Rod Kistler, Los Gatos, CA (US)

(73) Assignee: Lam Research Corporation, Fremont, CA (US)

( * ) Notice: Subject to any disclaimer, the term of this patent is extended or adjusted under 35 U.S.C. 154(b) by 87 days.

(21) Appl. No.: 10/027,947

(22) Filed: Dec. 20, 2001

(51) Int. Cl.[7] ..... B24B 1/00; B24B 7/00

(52) U.S. Cl. ..... 451/59; 451/41; 451/288; 451/290; 451/303; 451/311; 451/495

(58) Field of Search ..... 451/36, 41, 59, 451/63, 285, 286, 287, 288, 289, 290, 303, 311, 340, 489, 495, 526, 548, 550

(56) References Cited

U.S. PATENT DOCUMENTS 5,575,707 A * 11/1996 Talieh et al. ..... 451/173
5,593,344 A * 1/1997 Weldon et al. ..... 451/296
6,062,959 A * 5/2000 Weldon et al. ..... 451/307
6,261,959 B1 * 7/2001 Travis et al. ..... 438/692
6,387,289 B1 * 5/2002 Wright ..... 216/88
6,402,596 B1 * 6/2002 Hakomori et al. ..... 451/44
6,416,385 B2 * 7/2002 Ferri, et al. ..... 451/10
6,561,884 B1 * 5/2003 White et al. ..... 451/66

* cited by examiner

*Primary Examiner*—Timothy V. Eley
(74) *Attorney, Agent, or Firm*—Martine & Penilla, LLP

(57) ABSTRACT

An invention is provided for removal rate profile manipulation during a CMP process. An apparatus of the embodiments of the present invention includes an actuator capable of vertical movement perpendicular to a polishing surface of a polishing pad. The actuator is further capable of flexing the polishing pad independently of a pad support device. Also included in the apparatus is an actuator control mechanism that is in communication with the actuator. The actuator control mechanism is capable of controlling an amount of vertical movement of the actuator, allowing the actuator to provide local flexing of the polishing pad to achieve a particular removal rate profile. The actuator can also be capable of horizontal movement parallel to the polishing surface of the polishing pad.

22 Claims, 11 Drawing Sheets

APPARATUS FOR REMOVAL/REMAINING THICKNESS PROFILE MANIPULATION

BACKGROUND OF THE INVENTION

1. Field of the Invention

This invention relates generally to chemical mechanical planarization apparatuses, and more particularly to methods and apparatuses for improved uniformity in chemical mechanical planarization applications via a side double roller apparatus.

2. Description of the Related Art

In the fabrication of semiconductor devices, planarization operations, which can include polishing, buffing, and wafer cleaning, are often performed. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. Patterned conductive layers are insulated from other conductive layers by dielectric materials, such as silicon dioxide. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal planarization operations are performed to remove excess metallization. Further applications include planarization of dielectric films deposited prior to the metallization process, such as dielectrics used for shallow trench isolation or for poly-metal insulation. One method for achieving semiconductor wafer planarization is the chemical mechanical planarization (CMP) process.

In general, the CMP process involves holding and rubbing a typically rotating wafer against a moving polishing pad under a controlled pressure and relative speed. CMP systems typically implement orbital, belt, or brush stations in which pads or brushes are used to scrub, buff, and polish one or both sides of a wafer. Slurry is used to facilitate and enhance the CMP operation. Slurry is most usually introduced onto a moving preparation surface and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1A is a diagram showing a conventional table based CMP apparatus 50. The conventional table based CMP apparatus 50 includes a polishing head 52, which holds a wafer 54, and is attached to a translation arm 64. In addition, the table based CMP apparatus 50 includes a polishing pad 56 that is disposed above a polishing table 58, which is often referred to as a polishing platen.

In operation, the polishing head 52 applies downward force to the wafer 54, which contacts the polishing pad 56. Reactive force is provided by the polishing table 58, which resists the downward force applied by the polishing head 52. The polishing pad 56 is used in conjunction with slurry to polish the wafer 54. Typically, the polishing pad 56 comprises foamed polyurethane or a sheet of polyurethane having a grooved surface. The polishing pad 56 is wetted with a polishing slurry having both an abrasive and other polishing chemicals. In addition, the polishing table 58 is rotated about its central axis 60, and the polishing head 52 is rotated about its central axis 62. Further, the polishing head can be translated across the polishing pad 56 surface using the translation arm 64. In addition to the table based CMP apparatus 50 discussed above, linear belt CMP systems have been conventionally used to perform CMP.

FIG. 1B shows a side view of a conventional linear wafer polishing apparatus 100. The linear wafer polishing apparatus 100 includes a polishing head 108, which secures and holds a wafer 104 in place during processing. A polishing pad 102 forms a continuous loop around rotating drums 112, and generally moves in a direction 106 at a speed of about 400 feet per minute, however this speed may vary depending upon the specific CMP operation. As the polishing pad 102 moves, the polishing head 108 rotates and lowers the wafer 104 onto the top surface of the polishing pad 102, loading it with required polishing pressure.

A bearing platen manifold assembly 110 supports the polishing pad 102 during the polishing process. The platen manifold assembly 110 may utilize any type of bearing such as a fluid bearing or a gas bearing. The platen manifold assembly 110 is supported and held into place by a platen surround plate 116. Gas pressure from a gas source 114 is inputted through the platen manifold assembly 110 via a plurality of independently controlled of output holes that provide upward force on the polishing pad 102 to control the polishing pad profile.

Unfortunately, in each of the above CMP systems, non-uniformities can occur in material removal rate. Generally, to achieve uniform material removal, all parameters defining the material removal rate are required to be evenly distributed across the entire contact surface that interfaces with the wafer.

Edge instabilities in CMP are among the most significant performance affecting issues and among the most complicated problems to resolve. FIG. 2 is a diagram showing a wafer pad interface 200, illustrating edge effect non-uniformity factors. As shown in FIG. 2, when the wafer 54 contacts the polishing pad 56 during the CMP process, the flexibility in the polishing pad 56 allows the wafer 54 to form a depression in the polishing pad 56. More particularly, although the polishing pad 56 is a compressible medium, the polishing pad 56 has limited flexibility, which prevents the polishing pad 56 from conforming to the exact shape of the wafer 54, forming transient deformation zones. As a result, edge effects occur at the wafer edge 202 from a non-flat contact force field resulting from redistributed contact load. Hence, large variations in removal rates occur at the wafer edge 202.

Although the air bearing platen approach utilized in a linear wafer polishing apparatus can allow significant compensation for the above mentioned non-uniformity in the CMP process, the coupling of support and pad flexing functions limits the degrees of freedom available for each function. For example, if a process engineer adjusts the air pressure to provide additional support for the wafer and polishing pad, the pressure change will also affect pad flexing, which is also being performed by the air bearing. In addition, the conventional approaches require significant air consumption to meet uniformity targets.

In view of the foregoing, there is a need for CMP systems capable of compensating for process non-uniformity. The CMP systems should be capable of compensating for non-uniformity, such as edge effect, independently of other process functions, such as wafer and pad support.

SUMMARY OF THE INVENTION

Broadly speaking, the present invention fills these needs by providing polishing pad flexing techniques that allow independent flexing of a polishing pad for resolving non-uniformity during a CMP process. In one embodiment, an apparatus for removal rate profile manipulation during a CMP process is disclosed. The apparatus includes an actuator capable of vertical movement perpendicular to a polishing surface of a polishing pad. The actuator is further capable of flexing the polishing pad independently of a pad support device. Also included in the apparatus is an actuator control mechanism that is in communication with the actuator. The actuator control mechanism is capable of controlling an amount of vertical movement of the actuator, allowing the actuator to provide local flexing of the polishing pad to achieve a particular removal rate profile. The actuator can also be capable of horizontal movement parallel to the polishing surface of the polishing pad. In one aspect, the actuator can be a double roller that comprises a first roller above the polishing pad and a second roller below the polishing pad, allowing the polishing pad to be flexed toward a wafer being planarized and away from the wafer being planarized. In a further aspect, the actuator can be a double slider that comprises a first slider above the polishing pad and a second slider below the polishing pad, allowing the polishing pad to be flexed toward a wafer being planarized and away from the wafer being planarized. In one aspect, each slider can project a liquid or gas toward the polishing pad to reduce friction.

In a further embodiment, a method is disclosed for manipulating a removal rate profile during a CMP process. An actuator is provided that is capable of vertical movement perpendicular to a polishing surface of a polishing pad. As above, the actuator is capable of flexing the polishing pad independently of a pad support device. The vertical position of the actuator relative to the polishing pad is then altered to locally flex the polishing pad to achieve a particular removal rate profile. Optionally, the horizontal position of the actuator parallel to the polishing surface of the polishing pad can be altered to further locally flex the polishing pad to achieve a particular removal rate profile.

A system for removal rate profile manipulation during a CMP process is disclosed in a further embodiment of the present invention. The system includes a polishing pad comprising a flexible material that is capable of planarizing a wafer. Below the polishing pad is a pad support device that is capable of providing reactive force to the wafer during a CMP process. For example, the pad support device can be a polishing table or an air bearing. The system further includes an actuator that is capable of vertical movement perpendicular to a polishing surface of the polishing pad and horizontal movement parallel to the polishing pad. Further, the actuator is capable of flexing the polishing pad independently of the pad support device. In communication with the actuator is an actuator control mechanism. The actuator control mechanism is capable of controlling the amount of vertical and horizontal movement of the actuator, such that the actuator provides local flexing of the polishing pad to achieve a particular removal rate profile. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a polishing pad flexing apparatus that provides independent flexing of a polishing pad for resolving non-uniformity during a CMP process. Conventional linear belt CMP systems utilize platen air adjustments to adjust the shape of the polishing surface in a way that compensates for edge contact force distribution as well as for other sources of removal rate variation. Embodiments of the present invention allow decoupling of the support and shaping functions using a polishing pad flexing apparatus. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1A:
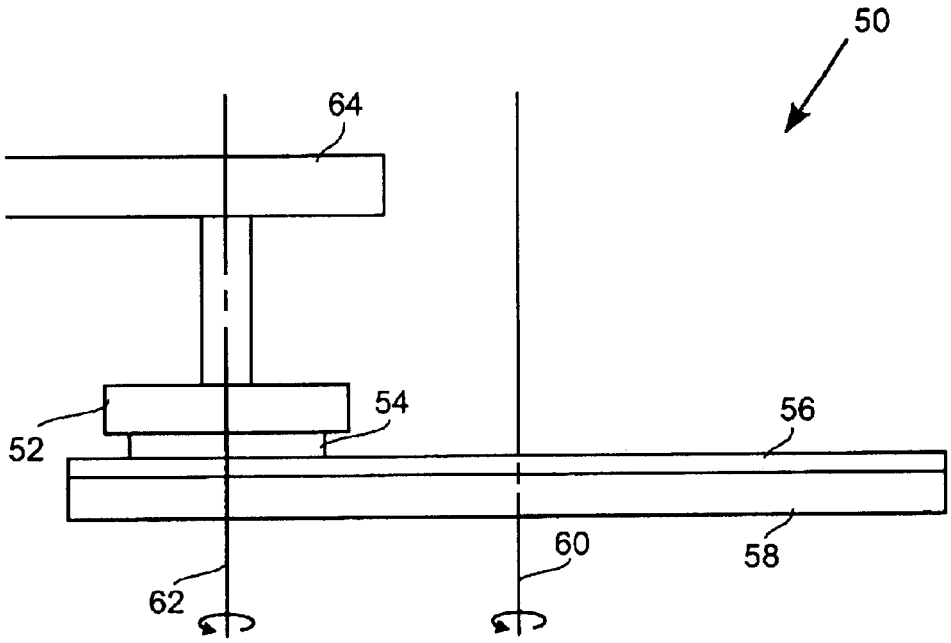
FIG. 1A (Prior Art)
FIG. 1A is a diagram showing a conventional table based CMP apparatus.
Figure 1B:
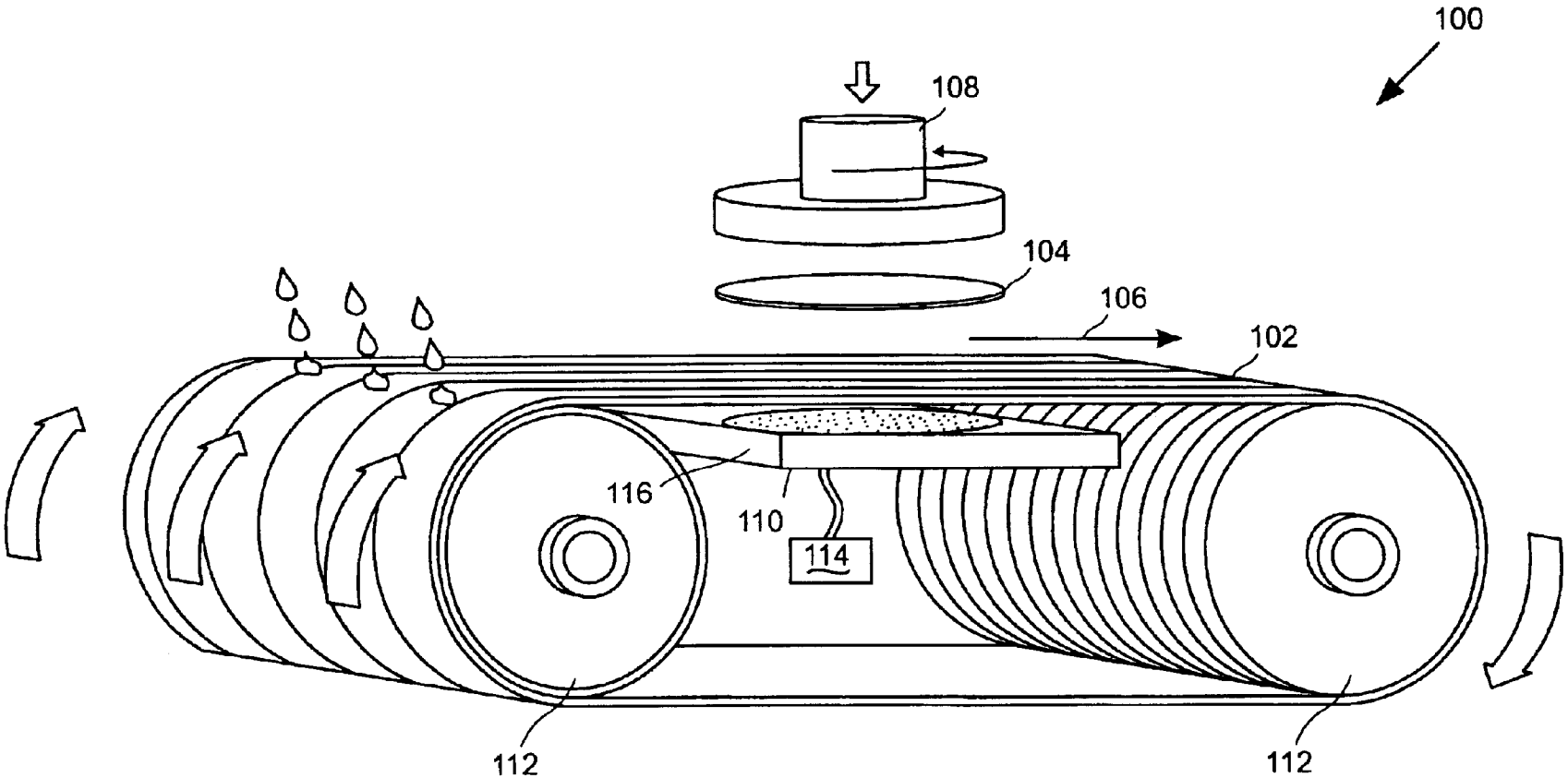
FIG. 1B (Prior Art)
FIG. 1B shows a side view of a conventional linear wafer polishing apparatus.
Figure 2:
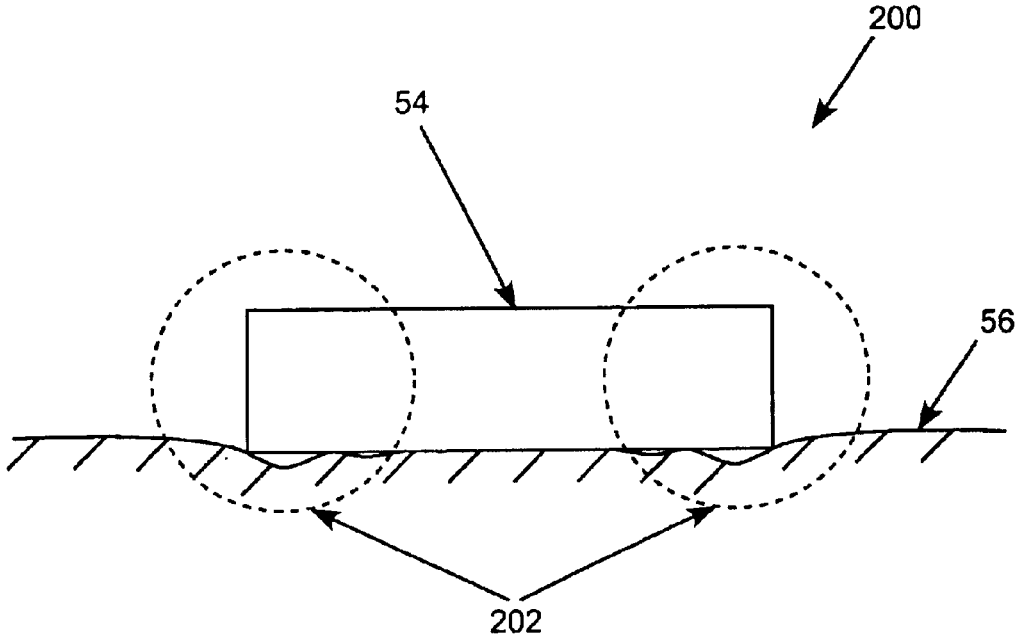
FIG. 2 (Prior Art)
FIG. 2 is a diagram showing a wafer pad interface, illustrating edge effect non-uniformity factors.
Figure 3:
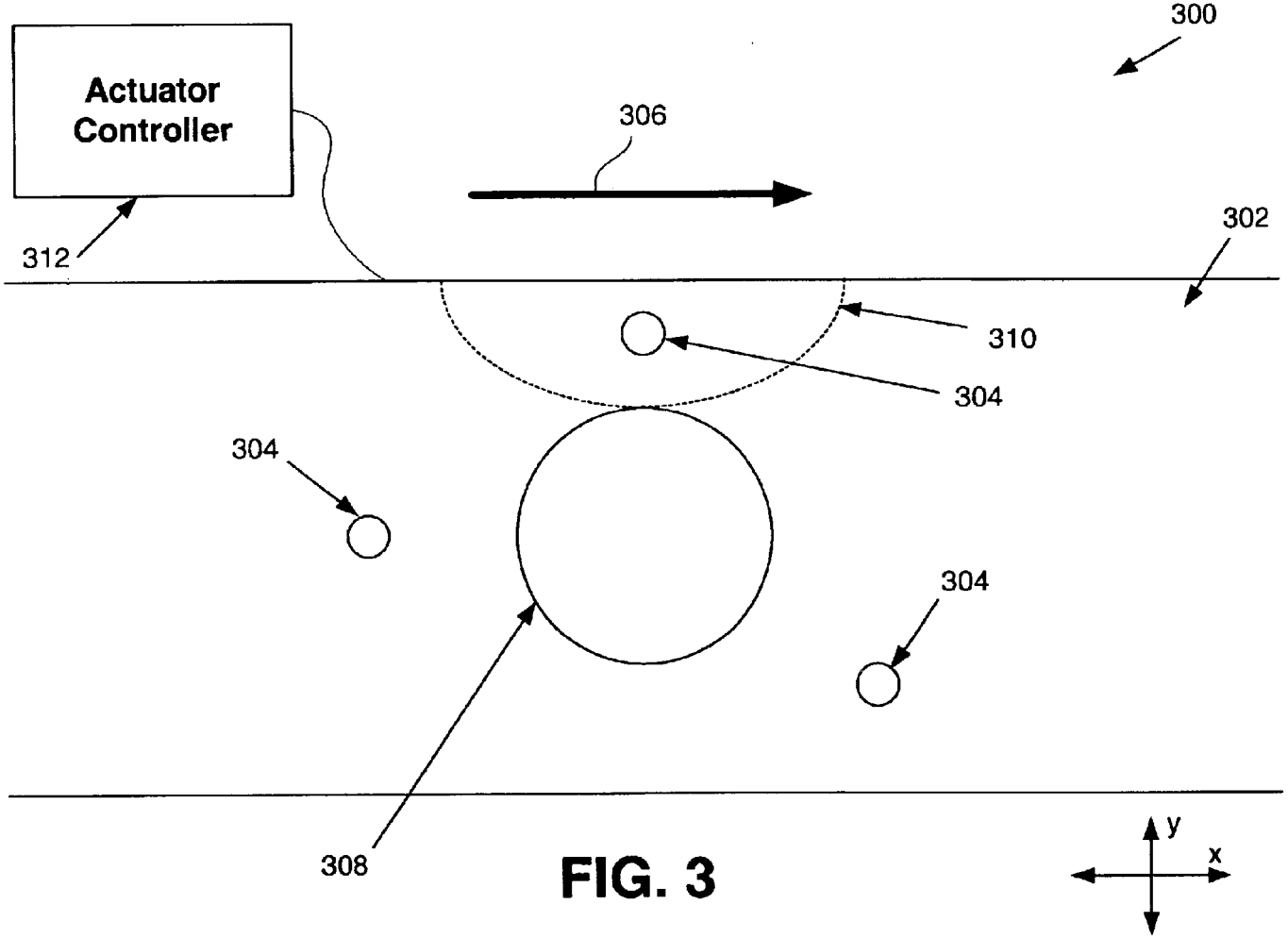
FIG. 3 is a diagram showing a linear based CMP system having an apparatus for removal rate and remaining thickness profile manipulation, in accordance with an embodiment of the present invention.

FIGS. 1A, 1B, and 2 have been described in terms of the prior art. FIG. 3 is a diagram showing a linear based CMP system 300 having an apparatus for removal rate and remaining thickness profile manipulation, in accordance with an embodiment of the present invention. The linear based CMP system 300 includes a polishing pad 302 comprising a flexible material, such as an open cell foamed polyurethane, a sheet of polyurethane having a grooved surface, or other material suitable for use as a polishing surface during CMP, and a plurality of actuators 304 capable of flexing the polishing pad 302.

The polishing pad 302 forms a continuous loop around rotating drums, and generally moves in a direction 306 at a speed of about 400 feet per minute, however this speed may vary depending upon the specific CMP operation. As the polishing pad 302 moves, a polishing head rotates and lowers a wafer 308 onto the top surface of the polishing pad 302.

In addition, a platen manifold assembly disposed below the wafer 308 and polishing pad 302 supports the polishing pad 302 during the polishing process. The platen manifold assembly may utilize any type of bearing such as a fluid bearing or a gas bearing, and is supported and held into place by a platen surround plate. Gas pressure from a gas source is inputted through the platen manifold assembly via a plurality of independently controlled of output holes that provide upward force on the polishing pad 302 to provide pad support and limited control of the polishing pad profile during a CMP process.

The actuators 304 provide local flexing of the polishing pad 302 to achieve a desired removal rate and remaining thickness profile. As mentioned previously, edge instabilities in CMP are among the most significant performance affecting issues and among the most complicated problems to resolve. During a conventional CMP process, the flexibility in the polishing pad allows the wafer to form a depression when the wafer contacts the polishing pad. Although the polishing pad is a compressible medium, the polishing pad has limited flexibility, which prevents the polishing pad from conforming to the exact shape of the wafer, forming transient deformation zones. As a result, edge effects occur at the wafer edge from a non-flat contact field resulting from redistributed contact forces. Hence, large variations in removal rates occur at the wafer edge.

Although the air bearing platen approached utilized in a linear wafer polishing apparatus can allow limited compensation for the above mentioned non-uniformity in the CMP process, the coupling of support and pad flexing functions limits the degrees of freedom available for each function. For example, if a process engineer adjusts the air pressure to provide additional support for the wafer and polishing pad, the pressure change will also affect pad flexing, which is also being performed by the air bearing.

Embodiments of the present invention address these non-uniformity issues utilizing actuators 304 which provide independent flexing of the polishing pad 302 to resolve non-uniformity issues during a CMP process. Although actuators of the embodiments of the present invention will be described in terms of non-uniformity resolution, it should be noted that the embodiments of the present invention can be utilized to provide any desired removal rate and thickness remaining profile. That is, CMP process engineers can utilize the embodiments of the present invention to achieve a fast removal rate at particular section of the wafer, and a slow removal rate at other sections of the wafer.

The actuators 304 provide local flexing of the polishing pad 302. For example, a particular actuator 304 positioned at the side of the polishing pad 302 can be utilized to flex the polishing pad 302 in a specific area 310 of the polishing pad 302. In one embodiment, each actuator 304 is capable of horizontal movement parallel to the polishing pad 302 to allow additional precision in flexing the polishing pad 302. In this manner, actuators 304 of the embodiments of the present invention can be positioned around the wafer 308 to create a desired removal rate. Control for the actuators 304 can be provided utilizing an actuator controller 312.

In one embodiment, the actuator controller 312 can include computer program instructions to automate a portion of the actuator control in response to a requested removal rate/remaining thickness profile. For example, the actuator controller 312 can control the position of each actuator based upon a current removal rate profile sensed using a film thickness detection apparatus. In addition, the actuator controller 312 can allow a user to individually control each actuator 304 along the x-axis, y-axis, and z-axis, as described in greater detail below, with reference to FIG. 4.

Figure 4:
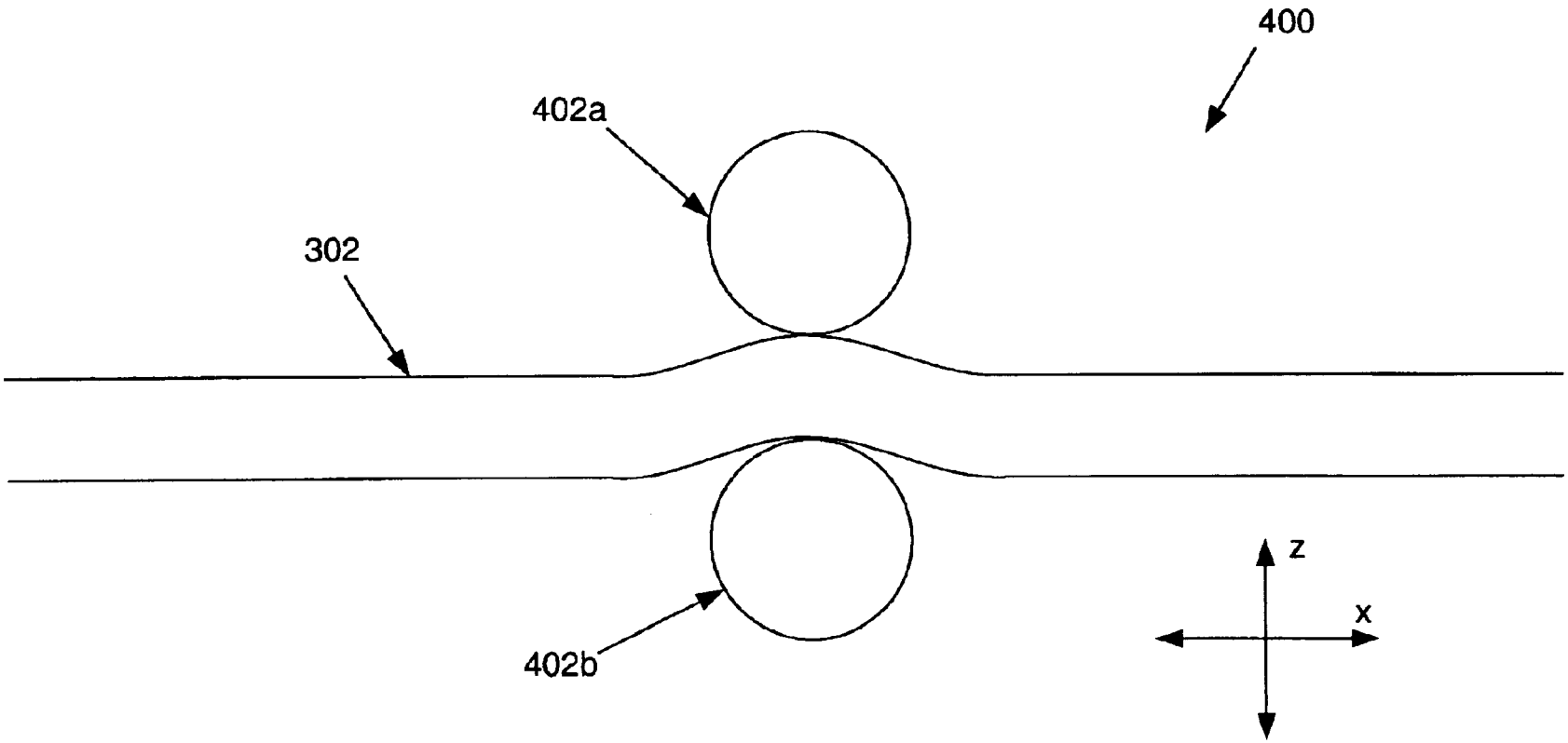
FIG. 4 is a diagram showing a double roller actuator 400, in accordance with an embodiment of the present invention.

FIG. 4 is a diagram showing a double roller actuator 400, in accordance with an embodiment of the present invention. The double roller actuator 400 comprises a first roller 402*a* disposed above the polishing pad 302, and a second roller 402*b* disposed below the polishing pad 302. The double roller actuator 400 allows vertical movement perpendicular to the polishing surface of the polishing pad 302. In particular, the first roller 402*a* allows the polishing pad 302 to be flexed in a direction away from a wafer being planarized, and the second roller 402*b* allows the polishing pad 302 to be flexed in a direction toward the wafer.

Further, the roller design of the double roller actuator 400 allows flexing of the polishing pad 302 with little or no friction being introduced from the double roller actuator 400. Used in combination with the horizontal actuator movement described previously with respect to FIG. 3, the vertical movement of the double roller actuator 400 allows the polishing pad 302 to be flexed to provide a desired wafer removal rate profile. Hence, the double roller actuator 400 of the embodiments of the present invention can be utilized to reduce or eliminate edge effect and other non-uniformity during the CMP process. In addition, the double roller actuator 400 of the embodiments of the present invention can be utilized to create a controlled non-uniform profile. For example, a CMP engineer can utilize the double roller actuator 400 to generate a fast removal rate profile at a specific section of the wafer surface, and a slower removal rate profile at another section of the wafer surface. In addition to a double roller actuator, embodiments of the present invention can be embodied utilizing a slider based actuator, as described next with respect to FIG. 5.

Figure 5:
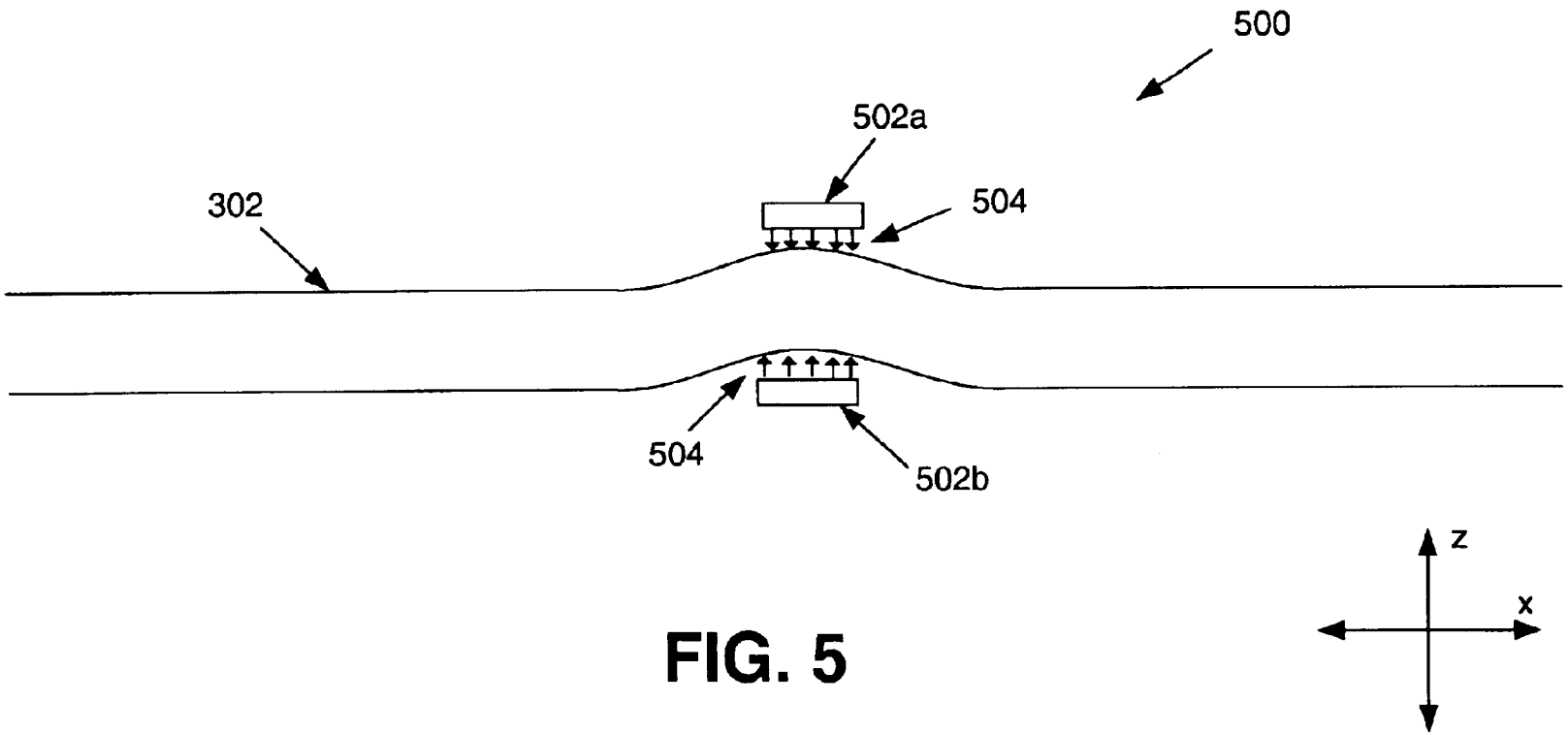
FIG. 5 is a diagram showing a double slider actuator, in accordance with an embodiment of the present invention.

FIG. 5 is a diagram showing a double slider actuator 500, in accordance with an embodiment of the present invention. The double slider actuator 500 comprises a first slider 502*a* disposed above the polishing pad 302, and a second slider 502*b* disposed below the polishing pad 302. Similar to the double roller actuator 400, the double slider actuator 500 allows vertical movement perpendicular to the polishing surface of the polishing pad 302. In particular, the first slider 502*a* allows the polishing pad 302 to be flexed in a direction away from a wafer being planarized, and the second slider 502*b* allows the polishing pad 302 to be flexed in a direction toward the wafer.

To reduce friction, the sliders 502*a* and 502*b* of the double slider actuator 500 can project a gas or liquid 504 toward the polishing pad 302, such as air or water. In this manner, the double slider actuator 500 can allow flexing of the polishing pad 302 with little or no friction being introduced from the double slider actuator 500. Used in combination with the horizontal actuator movement described previously with respect to FIG. 3, the vertical movement of the double slider actuator 500 allows the polishing pad 302 to be flexed to provide a desired wafer removal rate profile. Hence, the double slider actuator 500 of the embodiments of the present invention can be utilized to reduce or eliminate edge effect and other non-uniformity during the CMP process.

As with the double roller based actuator 400 described above with respect to FIG. 4, the double slider actuator 500 of the embodiments of the present invention can be utilized to create a controlled non-uniform profile. For example, a CMP engineer can utilize the double slider actuator 500 to generate a fast removal rate profile at a specific section of the wafer surface, and a slower removal rate profile at another section of the wafer surface. In addition to the double roller and slider actuator designs described above, embodiments of the present invention can be embodied utilizing a single roller and slider actuator design, as described next with respect to FIGS. 6A and 6B.

Figure 6A:
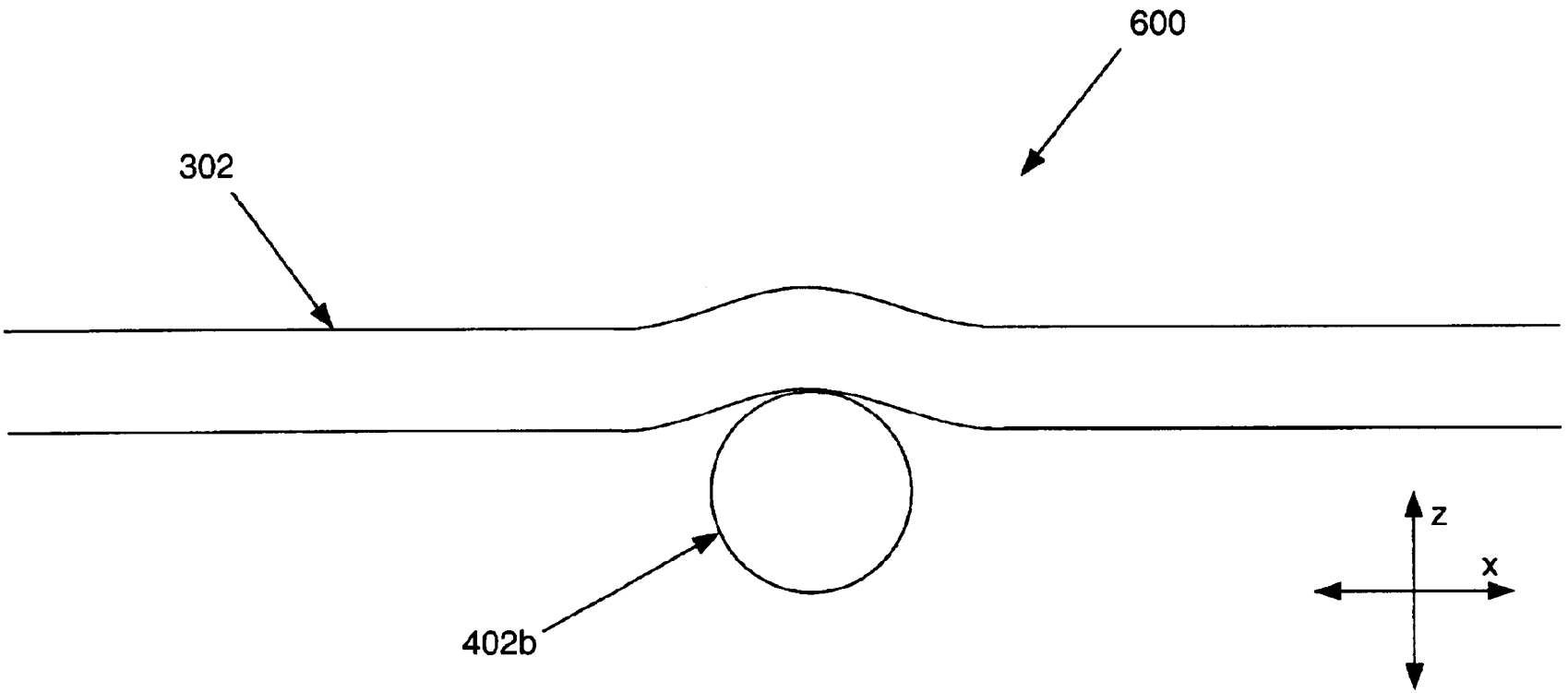
FIG. 6A is a diagram showing a single roller actuator, in accordance with an embodiment of the present invention.

FIG. 6A is a diagram showing a single roller actuator 600, in accordance with an embodiment of the present invention. The single roller actuator 600 comprises the second roller 402*b* disposed below the polishing pad 302. The single roller actuator 600 allows vertical movement perpendicular to the polishing surface of the polishing pad 302, thus allowing the polishing pad 302 to be flexed in a direction toward the wafer with little or no friction being introduced from the single roller actuator 600. Used in combination with the horizontal actuator movement described previously with respect to FIG. 3, the vertical movement of the single roller actuator 600 allows the polishing pad 302 to be flexed to provide a desired wafer removal rate profile. Hence, the single roller actuator 600 of the embodiments of the present invention can be utilized to reduce or eliminate edge effect and other non-uniformity during the CMP process. In addition, as with the double actuators 400 and 500 described previously, the single roller actuator 600 can be utilized to create a controlled non-uniform profile.

Figure 6B:
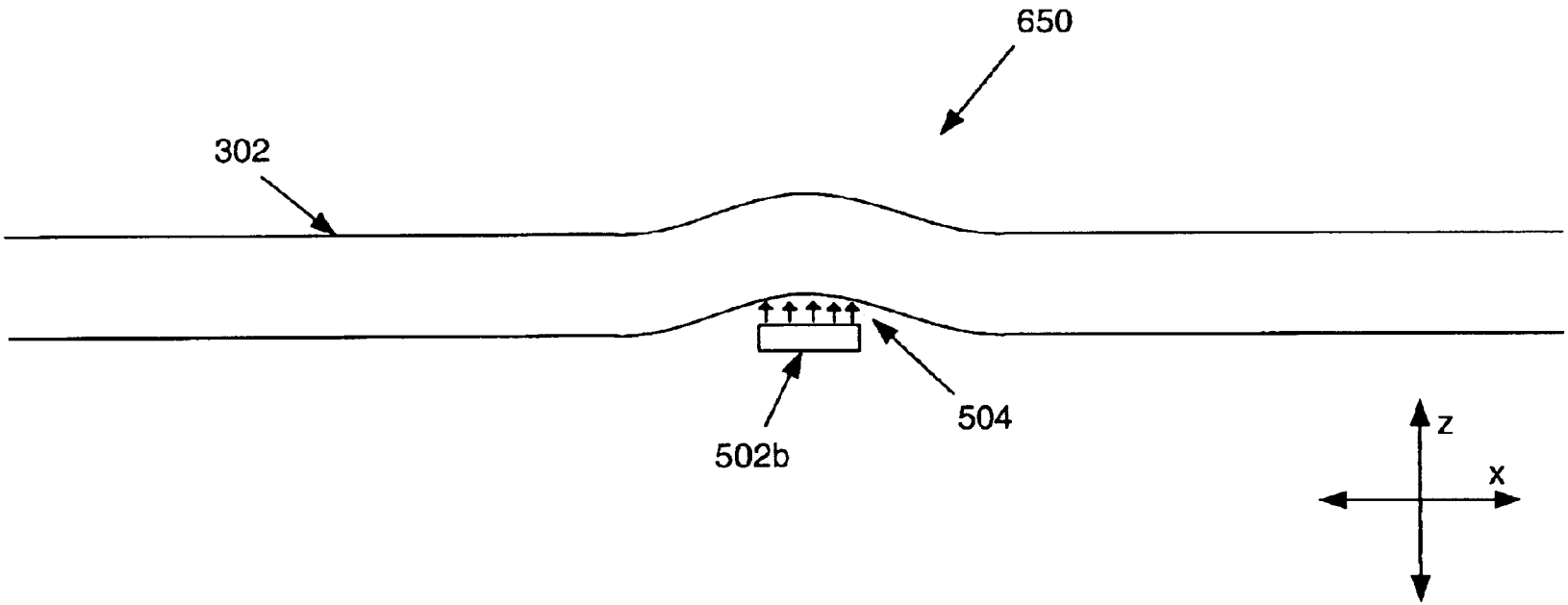
FIG. 6B is a diagram showing a single slider actuator, in accordance with an embodiment of the present invention.

FIG. 6B is a diagram showing a single slider actuator 650, in accordance with an embodiment of the present invention. The single slider actuator 650 comprises the second slider 502*b* disposed below the polishing pad 302. To reduce friction, the second slider 502*b* of the single slider actuator 650 can project a gas or liquid 504 toward the polishing pad 302, such as air or water. In this manner, the single slider actuator 650 allows flexing of the polishing pad 302 with little or no friction being introduced from the single slider actuator 650.

The single slider actuator 650 allows vertical movement perpendicular to the polishing surface of the polishing pad 302, thus allowing the polishing pad 302 to be flexed in a direction toward the wafer. Used in combination with the horizontal actuator movement described previously with respect to FIG. 3, the vertical movement of the single slider actuator 650 allows the polishing pad 302 to be flexed to provide a desired wafer removal rate profile. That is, the single slider actuator 650 of the embodiments of the present invention can be utilized to reduce or eliminate edge effect and other non-uniformity during the CMP process. In addition, as with the double actuators 400 and 500 described previously, the single slider actuator 650 can be utilized to create a controlled non-uniform profile.

Figure 7:
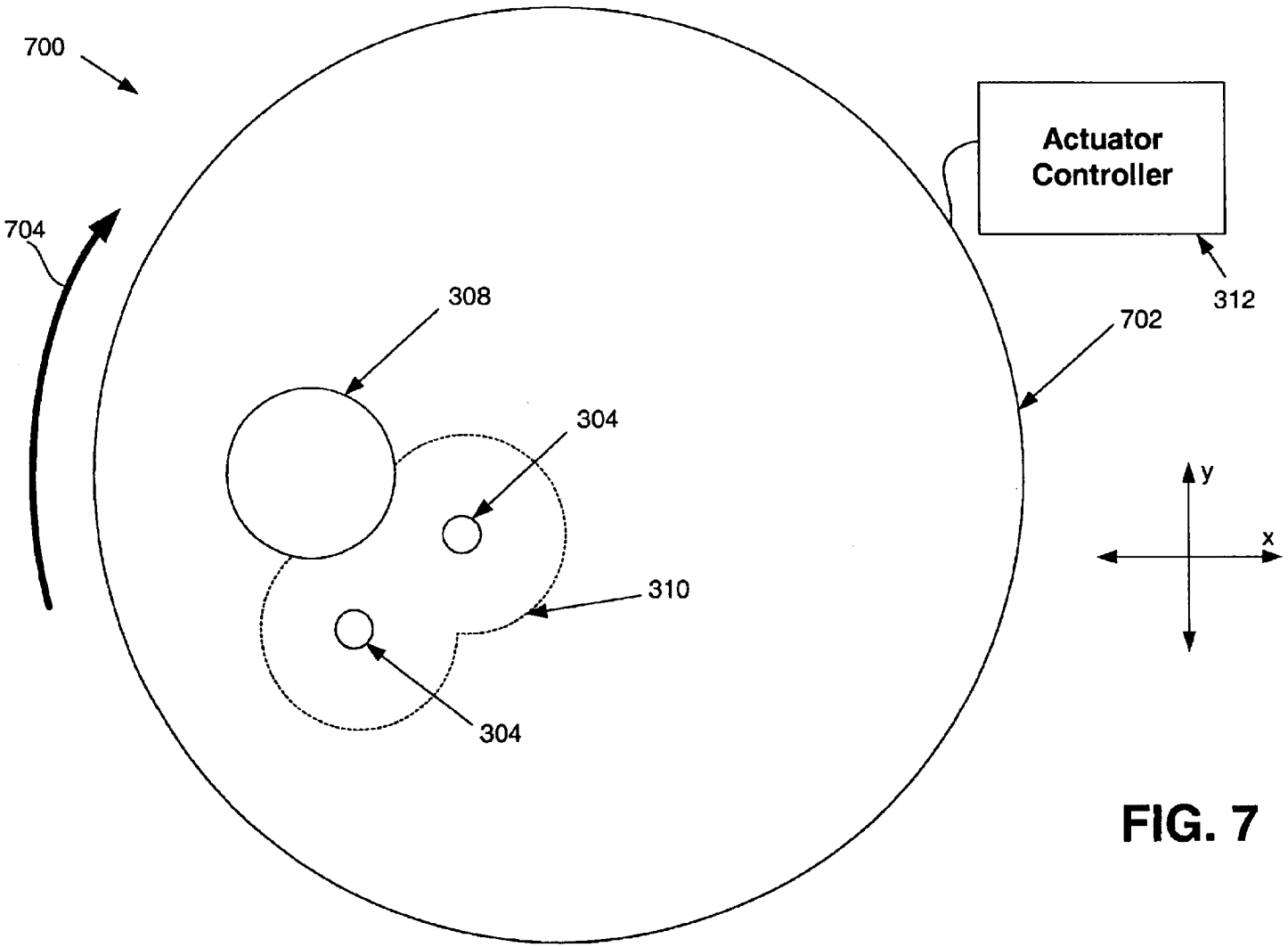
FIG. 7 is a diagram showing a table based CMP system having independent pad flexing actuators, in accordance with an embodiment of the present invention.

The independent pad flexing actuators of the embodiments of the present invention can further be used to control pad flexing in a table based CMP system. FIG. 7 is a diagram showing a table based CMP system 700 having independent pad flexing actuators, in accordance with an embodiment of the present invention. The table based CMP system 700 includes a polishing pad 702 comprising a flexible material, such as an open cell foamed polyurethane, a sheet of polyurethane having a grooved surface, or other material suitable for use as a polishing surface during CMP, and a plurality of actuators 304 capable of flexing the polishing pad 702. As described previously, the polishing pad 702 rotates in a direction 704 about a central axis. As the polishing pad 702 moves, a polishing head rotates and lowers the wafer 308 onto the top surface of the polishing pad 702.

The actuators 304 provide local flexing of the polishing pad 702 to achieve a desired removal rate and remaining thickness profile. As mentioned previously, edge instabilities in CMP are among the most significant performance affecting issues and among the most complicated problems to resolve. Hence, large variations in removal rates occur at the wafer edge.

Embodiments of the present invention address these non-uniformity issues utilizing actuators 304 which provide independent flexing of the polishing pad 702 to resolve non-uniformity during a CMP process. The actuators 304 provide local flexing of the polishing pad 702. For example, actuators 304 positioned on the polishing pad 702 at the leading edge of the wafer 308 can be utilized to flex the polishing pad 702 in a specific area 310. In one embodiment, each actuator 304 is capable of horizontal movement parallel to the polishing pad 702 to allow additional precision in flexing the polishing pad 302. In this manner, actuators 304 of the embodiments of the present invention can be positioned around the wafer 308 to create a desired removal rate. Control for the actuators 304 can be provided utilizing an actuator controller 312.

As mentioned previously, the actuator controller 312 can include computer program instructions to automate a portion of the actuator control in response to a requested removal rate/remaining thickness profile. For example, the actuator controller 312 can control the position of each actuator based upon a current removal rate profile sensed using a film thickness detection apparatus. In addition, the actuator controller 312 can allow a user to individually control each actuator 304 along the x-axis, y-axis, and z-axis, as described in greater detail below, with reference to FIG. 8.

Figure 8:
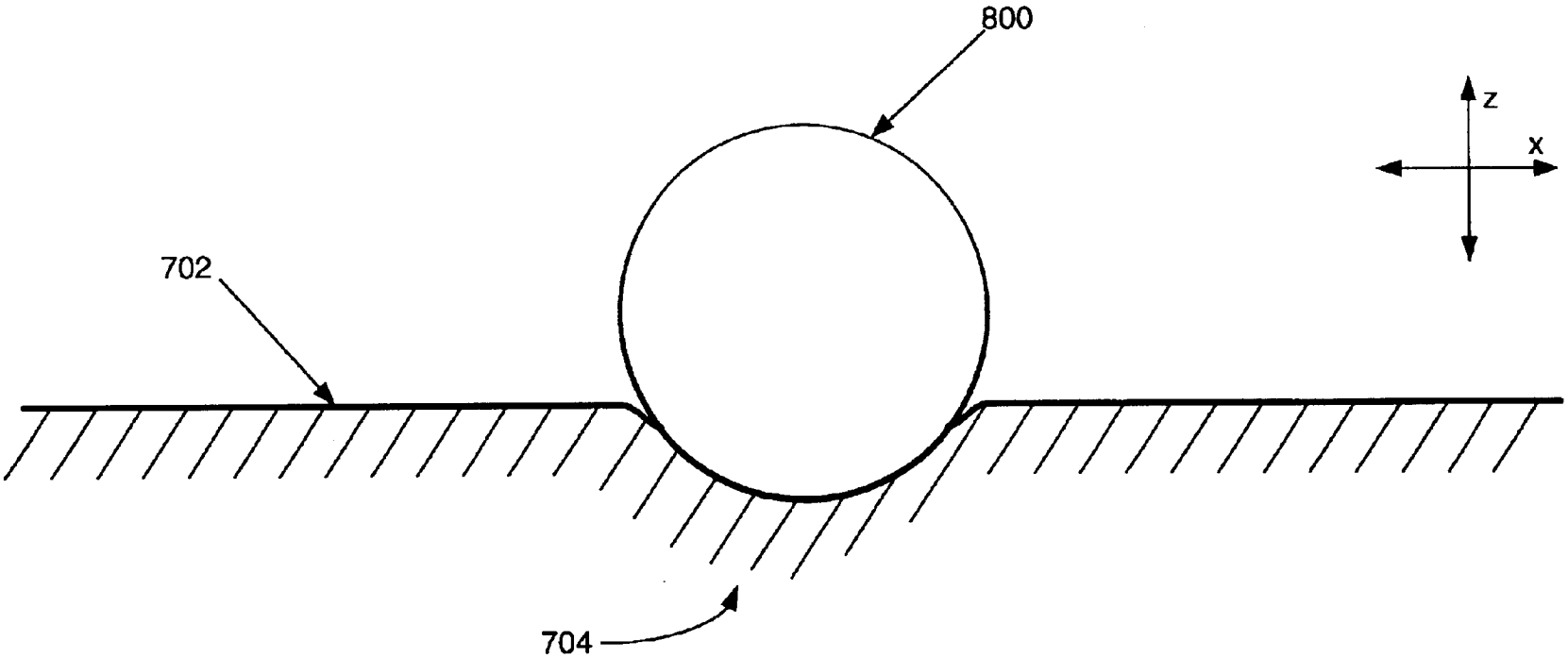
FIG. 8 is a diagram showing a roller actuator, in accordance with an embodiment of the present invention.

FIG. 8 is a diagram showing a roller actuator 800, in accordance with an embodiment of the present invention. The roller actuator 800 is disposed above the polishing pad 702, and allows vertical movement perpendicular to the polishing surface of the polishing pad 702. In particular, the roller actuator 800 can shape the polishing pad 702 by creating depressions 704 in the polishing pad 702, which flex the polishing surface of the polishing pad 702 to create a desired removal rate/remaining thickness profile with little or no friction being introduced from the roller actuator 800.

The horizontal and vertical actuator movement of the roller actuator 800 allows the polishing pad 702 to be flexed to provide a desired wafer removal rate profile. Hence, the roller actuator 700 of the embodiments of the present invention can be utilized to reduce or eliminate edge effect and other non-uniformity during the CMP process. In addition, as with the linear based CMP actuators described previously, the roller actuator 800 can be utilized to create a controlled non-uniform profile.

Figure 9:
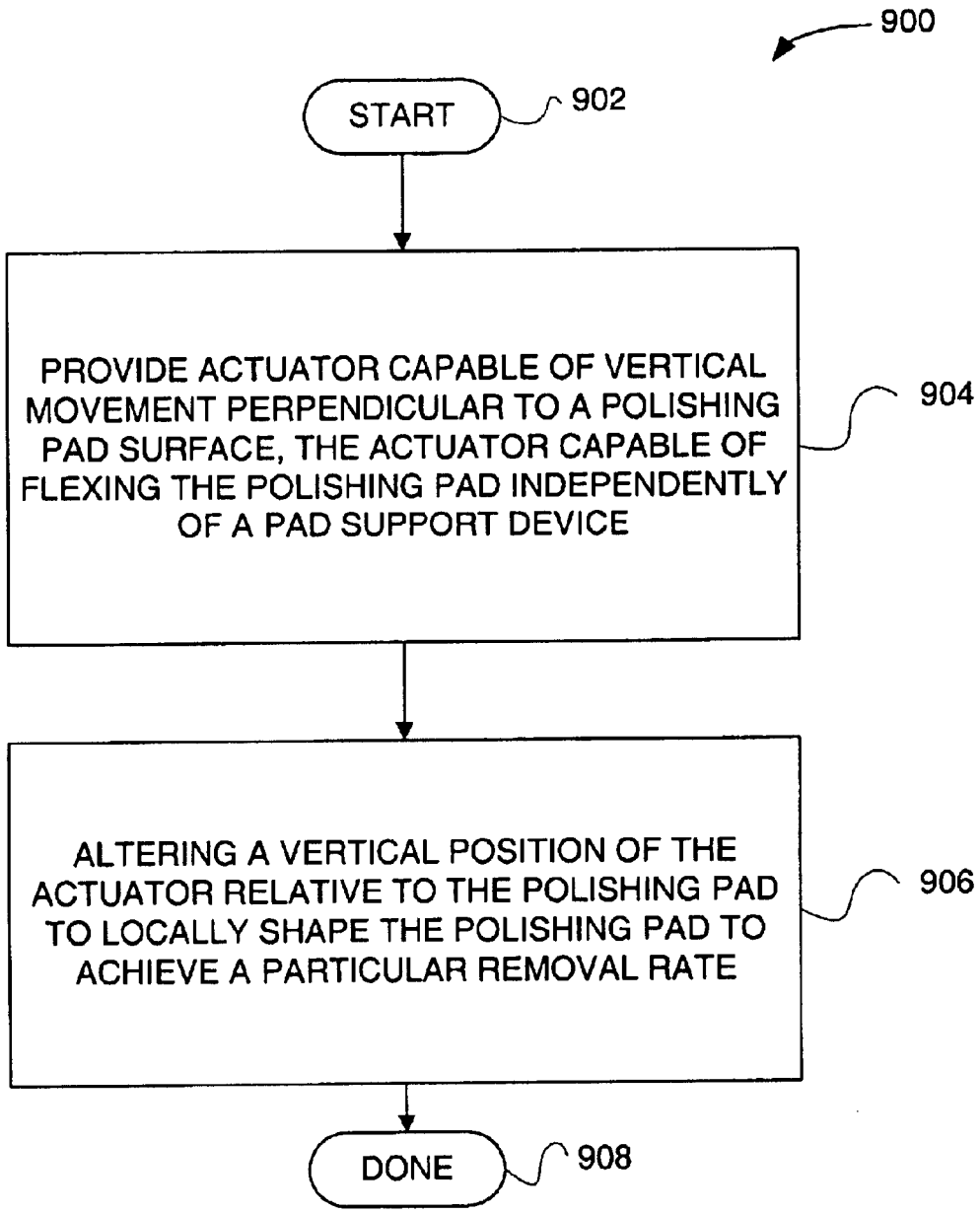
FIG. 9 is a flowchart showing method for manipulating a removal rate profile during a CMP process, in accordance with an embodiment of the present invention.

FIG. 9 is a flowchart showing method 900 for manipulating a removal rate profile during a CMP process, in accordance with an embodiment of the present invention. In an initial operation 902, preprocess operations are performed. Preprocess operations can include applying a patterned mask to the wafer, etching the surface of the wafer, cleaning the wafer, thin film deposition, and other preprocess operations that will be apparent to those skilled in the art.

In operation 904, an actuator is provided that is capable of vertical movement perpendicular to the polishing pad surface and further capable of flexing the polishing pad independently of a pad support device. As mentioned previously, embodiments of the present invention address non-uniformity issues utilizing actuators, which provide independent flexing of the polishing pad to resolve non-uniformity during a CMP process. The actuators can comprise rollers, sliders, or any other mechanism capable of exerting force on the polishing pad and flexing the polishing surface to create a desired removal rate profile. For linear based CMP systems, the actuators can comprise double rollers and sliders that allow vertical pad movement in both directions along the z-axis, as well as horizontal placement of the actuator parallel to the polishing pad. For table based CMP systems, the actuators can comprise rollers, sliders or any other mechanism capable of compressing the polishing pad and flexing the polishing surface to create a desired removal rate profile.

In operation 906, the vertical position of the actuator relative to the polishing pad is altered to locally flex the polishing pad to achieve a particular removal rate. The vertical movement of the actuator allows the polishing pad to be shaped to provide a desired wafer removal rate profile. Hence, the actuator of the embodiments of the present invention can be utilized to reduce or eliminate edge effect and other non-uniformity during the CMP process. In addition, the actuator of the embodiments of the present invention can be utilized to create a controlled non-uniform profile. For example, a CMP engineer can utilize the double roller actuator to generate a fast removal rate profile at a specific section of the wafer surface, and a slower removal rate profile at another section of the wafer surface.

Post process operations are performed in operation 908. Post process operations can include conditioning the polishing surface, process endpoint detection, and further wafer processing operations that will be apparent to those skilled in the art. In this manner, embodiments of the present invention can compensate for non-uniformity and generate desired removal rate profiles.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for manipulating a removal rate profile during a chemical mechanical planarization (CMP) process, comprising:

providing an actuator capable of vertical movement perpendicular to a polishing surface of a polishing pad stretched between first and second rotating drums, the actuator capable of flexing the polishing pad between the first and second rotating drums and independently of a pad support device; and altering a vertical position of the actuator relative to the polishing pad to locally flex the polishing pad to achieve a particular removal rate profile.

2. A method as recited in claim 1, further comprising the operation of altering a horizontal position of the actuator parallel to the polishing surface of the polishing pad to locally flex the polishing pad to achieve a particular removal rate profile.

3. A method as recited in claim 2, wherein the actuator is a double roller comprising a first roller above the polishing pad and a second roller below the polishing pad.

4. A method as recited in claim 2, wherein the actuator is a double slider comprising a first slider above the polishing pad and a second slider below the polishing pad.

5. A method as recited in claim 4, wherein each slider projects a liquid toward the polishing pad to reduce friction.

6. A method as recited in claim 4, wherein each slider projects a gas toward the polishing pad to reduce friction.

7. An apparatus for removal rate profile manipulation during a chemical mechanical planarization (CMP) process, comprising:

a polishing pad stretched between a first and second rotating drums;

an actuator capable of vertical movement perpendicular to a polishing surface of the polishing pad, the actuator being positioned between the first and second rotating drums and capable of flexing the polishing pad independently of a pad support device that is positioned between the first and second rotating drums; and an actuator control mechanism in communication with the actuator, the actuator control mechanism capable of controlling an amount of vertical movement of the actuator, wherein the actuator provides local flexing of the polishing pad to achieve a particular removal rate profile.

8. An apparatus as recited in claim 7, wherein the actuator is further capable of horizontal movement parallel to the polishing surface of the polishing pad.

9. An apparatus as recited in claim 8, wherein the actuator is a double roller.

10. An apparatus as recited in claim 9, wherein the double roller comprises a first roller above the polishing pad and a second roller below the polishing pad.

11. An apparatus as recited in claim 10, wherein the double roller is capable of flexing the polishing pad toward a wafer being planarized and away from the wafer being planarized.

12. An apparatus as recited in claim 8, wherein the actuator is a double slider.

13. An apparatus as recited in claim 12, wherein the double slider comprises a first slider above the polishing pad and a second slider below the polishing pad.

14. An apparatus as recited in claim 13, wherein the double slider is capable of flexing the polishing pad toward a wafer being planarized and away from the wafer being planarized.

15. An apparatus as recited in claim 13, wherein each slider projects a liquid toward the polishing pad to reduce friction.

16. An apparatus as recited in claim 13, wherein each slider projects a gas toward the polishing pad to reduce friction.

17. A system for removal rate profile manipulation during a chemical mechanical planarization (CMP) process, comprising:

a polishing pad capable of planarizing a wafer, the polishing pad being stretched between first and second rotating drums, wherein the polishing pad comprises a flexible material;

a pad support device disposed below the polishing pad, the pad support capable of providing reactive force to the wafer during a CMP process;

an actuator capable of vertical movement perpendicular to a polishing surface of the polishing pad and horizontal movement parallel to the polishing pad, the actuator capable of flexing the polishing pad independently of the pad support device and between the first and second rotating drums; and an actuator control mechanism in communication with the actuator, the actuator control mechanism capable of controlling an amount of vertical and horizontal movement of the actuator, wherein the actuator provides local flexing of the polishing pad to achieve a particular removal rate profile.

18. A system as recited in claim 17, wherein the actuator is a double roller comprising a first roller above the polishing pad and a second roller below the polishing pad.

19. A system as recited in claim 17, wherein the actuator is a double slider comprising a first slider above the polishing pad and a second slider below the polishing pad.

20. A system as recited in claim 19, wherein each slider projects a liquid toward the polishing pad to reduce friction.

21. An apparatus for removal rate profile manipulation during a chemical mechanical planarization (CMP) process, comprising:

a double roller actuator capable of vertical movement perpendicular to a polishing surface of a polishing pad, the double roller actuator capable of flexing the polishing pad independently of a pad support device; and an actuator control mechanism in communication with the double roller actuator, the actuator control mechanism capable of controlling an amount of vertical movement of the double roller actuator, wherein the double roller actuator provides local flexing of the polishing pad to achieve a particular removal rate profile.

22. An apparatus for removal rate profile manipulation during a chemical mechanical planarization (CMP) process, comprising:

a double slider actuator capable of vertical movement perpendicular to a polishing surface of a polishing pad, the double slider actuator capable of flexing the polishing pad independently of a pad support device; and an actuator control mechanism in communication with the double slider actuator, the actuator control mechanism capable of controlling an amount of vertical movement of the double slider actuator, wherein the double slider actuator provides local flexing of the polishing pad to achieve a particular removal rate profile.

* * * * *